United States Patent [19]

Jones

[11] 4,204,487

[45] May 27, 1980

[54] INTERNAL COMBUSTION ENGINES

[75] Inventor: Maurice Jones, Huddersfield, England

[73] Assignee: David Brown Tractors Limited, England

[21] Appl. No.: 898,236

[22] Filed: Apr. 20, 1978

[30] Foreign Application Priority Data

Apr. 28, 1977 [GB] United Kingdom ..... 17743/77

[51] Int. Cl.[2] ..... F01P 3/06

[52] U.S. Cl. ..... 123/41.35; 123/196 AB

[58] Field of Search ..... 123/41.35, 41.36, 41.34, 123/41.39, 196 R, 196 CP, 196 V, 196 AB; 184/104 B, 6.22, 6.5

[56] References Cited

U.S. PATENT DOCUMENTS

| | | | |
|---|---|---|---|
| 2,788,773 | 4/1957 | Meurer | 123/41.35 |
| 2,800,119 | 7/1957 | Schmidt | 123/41.35 |
| 3,065,743 | 11/1962 | Brehm et al. | 123/41.35 |
| 4,010,718 | 3/1977 | Stewart | 123/41.35 |
| 4,114,571 | 9/1978 | Ruf | 123/41.35 |
| 4,129,108 | 12/1978 | Elsbett | 123/41.35 |
| 4,142,484 | 3/1979 | Buhl | 123/41.35 |

*Primary Examiner*—Ronald H. Lazarus

[57] ABSTRACT

An internal combustion engine of the reciprocating piston type has oil jets for cooling the pistons. The jets are fed by the pump which supplies oil to the engine's lubrication system. A valve in the feed line to the jets is arranged to close automatically when the pressure of oil flowing through it falls below a determined value due to the engine and thus the pump running temporarily at low speed, so as to give priority to the lubrication system at such times.

4 Claims, 3 Drawing Figures

INTERNAL COMBUSTION ENGINES

BACKGROUND OF INVENTION

The invention relates to internal combustion engines of the type having at least one cylinder in which there is reciprocable a piston, and a pressurised bearing lubrication system.

The object of the invention is to employ lubricating oil to cool the piston or pistons without starving the bearings of lubricating oil.

SUMMARY OF INVENTION

According to the invention an internal combustion engine, of the type having at least one cylinder in which there is reciprocable a piston, comprises a lubrication system including a pump delivering oil under pressure through a first feed line to the engine's bearings, a second feed line connecting the first feed line to at least one oil jet directed into the or each cylinder for cooling the piston therein, and a valve in the second feed line for closing said line to prevent the flow of oil to the oil jet or jets when the pressure acting on said valve is less than a determined value.

BRIEF DESCRIPTION OF DRAWINGS

A preferred embodiment of the invention will now be described, by way of example, with reference to the accompanying drawings of which.

DESCRIPTION OF PREFERRED EMBODIMENT

Figure 1:
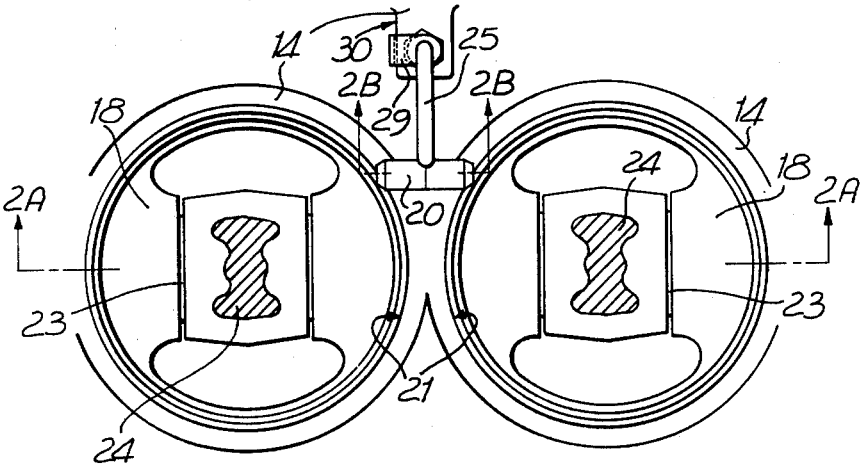
FIG. 1 is a view on the underside of two adjacent cylinders of a multi-cylinder in-line internal combustion engine.

Referring now to the drawings, a multi-cylinder in-line internal combustion engine is provided with a conventional lubrication system comprising a pump 10 driven by the engine, which draws oil from a sump 11 and delivers it under pressure through a feed line 12 to a main oil gallery 13 in the engine's cylinder block 14, said gallery being connected to lubricate the engine's bearings (including the big-end bearings 15), tappets (not shown) and the like. A filter 16 is interposed in the feed line 12 between the pump 10 and the oil gallery 13, and a spring-closed maximum pressure relief valve 17 disposed between the pump 10 and the filter 16 is arranged to open so as to connect the feed line 12 to the sump 11 at a pressure of, say, approximately 45 pounds per square inch.

In order to cool the engine's pistons 18, oil jets 19 of, say, 5/64" diameter and, say 60° inclination above the horizontal are formed in cylindrical members 20 disposed near the lower ends of the cylinders 21. Each member 20 has one jet 19 at each of its ends, and thus serves to cool the pistons 18 in two adjacent cylinders 21. Each piston 18 is connected in well-known manner to the engine's crankshaft 22 by means of a gudgeon pin 23 and a connecting rod 24. The members 20 are connected by respective pipes 25 to a subsidiary oil gallery 26 in the cylinder block 14, said gallery being connected in its turn to a point in the afore-mentioned feed line 12 (hereinafter called the first feed line) between the filter 16 and the main oil gallery 13 by way of a second feed line 27. A spring-closed low pressure relief valve 28 interposed in the second feed line 27 is arranged to open said line at a pressure of, say, approximately 30 pounds per square inch. A tab 29 secured to each pipe 25 is bent into contact with a surface 30 in the cylinder block 14 to prevent each member 20 from moving out of its operative position.

An oil cooler may be provided in the system to extract excess heat from the oil.

In a modification, the oil jets may be formed directly in the walls in the cylinders, near their lower ends.

Figure 3:
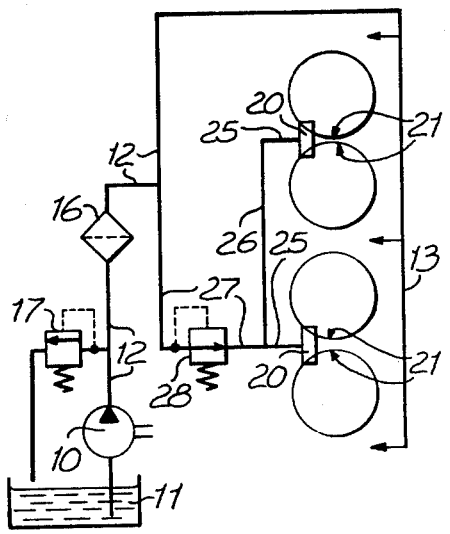
FIG. 3 is a diagrammatic view of the engine's lubrication system.
Figure 2:
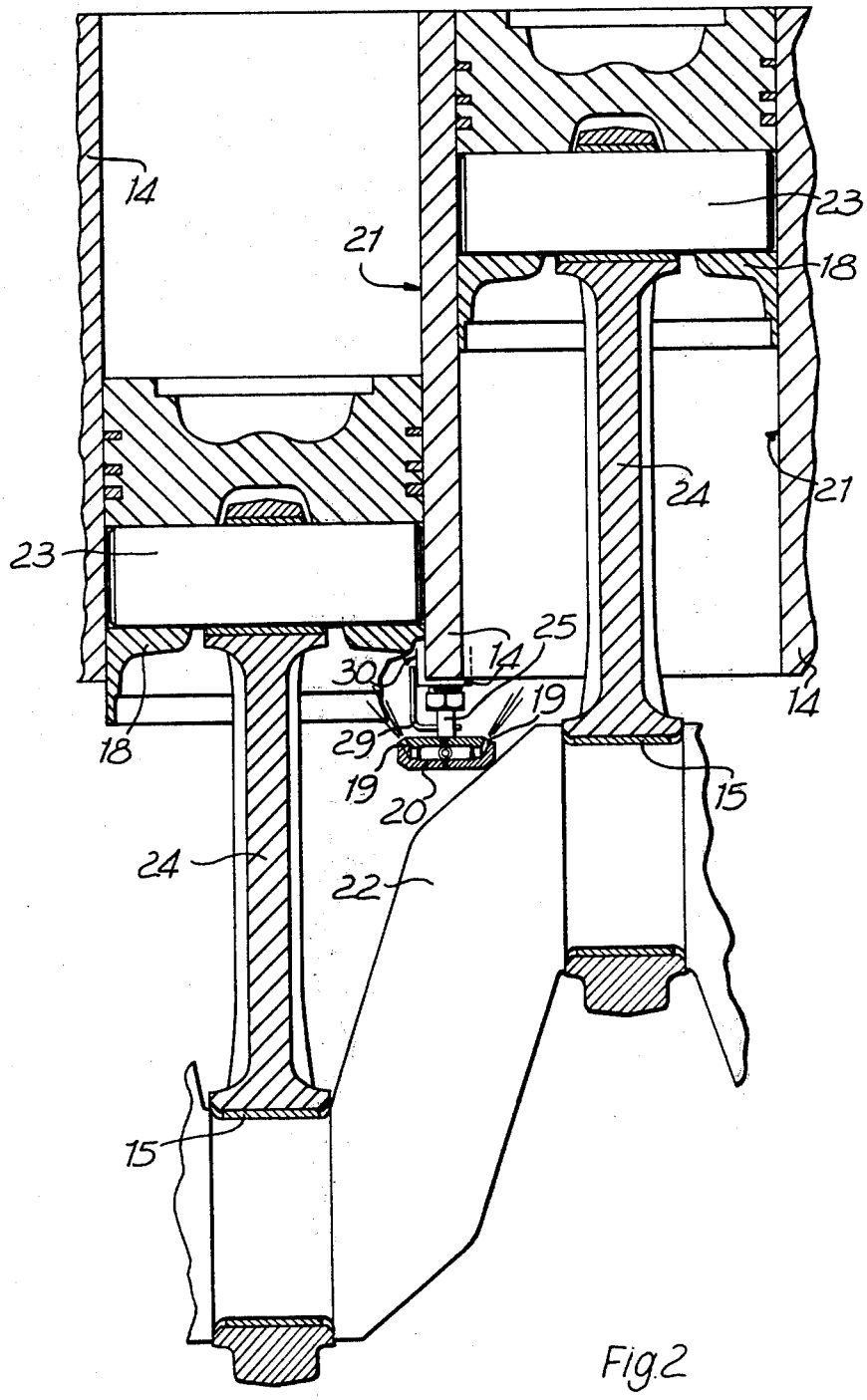
FIG. 2 is a section mainly on the line *2a—2a* in FIG. 1 but also in part on the line *2b—2b* in FIG. 1.

In operation, when the engine speed is low the flow rate and pressure of the discharge of the pump 10 are correspondingly low. To avoid the risk of starving the bearings, tappets and the like of oil in these circumstances, the low pressure relief valve 28 holds the second feed line 27 closed to prevent the flow of oil to the oil jets 29 until such time as an increase in engine speed causes a pressure of approximately 30 pounds per square inch to be attained in the first feed line 12 between the filter 16 and the main oil gallery 13, whereupon the valve 28 opens and permits oil to be supplied to the jets 19 as shown in FIG. 3. Oil sprayed from the jets 19 thus impinges upon the internal surfaces of the pistons 18 and abstracts excess heat therefrom, and then drains from the cylinders 21 into the sump 11 for recirculation. In the course of recirculation it passes through the oil cooler if one is provided. At engine speeds lower than that capable of producing and oil pressure of approximately 30 pounds per square inch the pistons 18 do not require cooling, because excessively hot conditions only occur at higher engine speeds.

I claim:

1. An internal combustion engine, of the type having at least one cylinder in which there is reciprocable a piston, comprising a lubrication system including a pump drawing oil from a sump and delivering it under pressure through a first feed line to the engine's bearings, maximum pressure relief valve means connecting the first feed line directly to the sump, a second feed line connecting the first feed line at a point downstream of the maximum pressure relief valve means to at least one oil jet directed into the or each cylinder for cooling the piston therein, all of the oil flowing through the second feed line returning to the sump by way of the oil jet or jets, and low pressure relief valve means in the second feed line for closing said line to prevent the flow of oil to the oil jet or jets when the pressure acting on the low pressure relief valve means is less than a determined value.

2. A multi-cylinder internal combustion engine according to claim 1, wherein the first feed line communicates with the bearings by way of a main oil gallery and the second feed line communicates with the oil jet or jets by way of a subsidiary oil gallery.

3. An internal combustion engine according to claim 1, wherein a filter is disposed in the first feed line between the maximum pressure relief valve means (pump) and the second feed line.

4. An internal combustion engine according to claim 1, wherein the low pressure relief valve means are (valve is ) arranged to open the second feed line when the pressure acting on said valve means reaches approximately 30 pounds per square inch.

* * * * *